US009675996B2

(12) United States Patent
O'Leary et al.

(10) Patent No.: US 9,675,996 B2
(45) Date of Patent: Jun. 13, 2017

(54) EMBOSSED HEAT TRANSFER LABELS

(71) Applicant: Illinois Tool Works Inc., Glenview, IL (US)

(72) Inventors: Caroline M. O'Leary, Cork (IE); Celine M. Cremin, Cork (IE); William J. Stevenson, Vernon, CT (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 14/870,593

(22) Filed: Sep. 30, 2015

(65) Prior Publication Data

US 2016/0129718 A1 May 12, 2016

Related U.S. Application Data

(60) Provisional application No. 62/078,775, filed on Nov. 12, 2014.

(51) Int. Cl.

| | |
|---|---|
| ***B41M 3/12*** | (2006.01) |
| ***B41M 5/382*** | (2006.01) |
| ***B44C 1/17*** | (2006.01) |
| ***B05D 3/06*** | (2006.01) |
| ***B05D 1/32*** | (2006.01) |
| ***B05D 5/00*** | (2006.01) |

(52) U.S. Cl.

CPC ..... *B05D 3/067* (2013.01); *B05D 1/32* (2013.01); *B05D 5/00* (2013.01); *B41M 3/12* (2013.01); *B41M 5/38214* (2013.01); *B41M 5/38228* (2013.01); *B41M 5/38264* (2013.01); *B44C 1/1712* (2013.01)

(58) Field of Classification Search

CPC .... B41M 3/12; B41M 5/382; B41M 5/38214; B41M 5/38228; B41M 5/38264; B41M 2205/10; B44C 1/17; B44C 1/172; B05D 3/067

USPC ..... 428/32.79, 32.81, 32.77–32.82; 427/147, 427/208.2, 511

See application file for complete search history.

(56) References Cited

U.S. PATENT DOCUMENTS

| | | | |
|---|---|---|---|
| 4,810,549 | A | 3/1989 | Abrams et al. |
| 5,207,851 | A | 5/1993 | Abrams |

(Continued)

FOREIGN PATENT DOCUMENTS

| | | | |
|---|---|---|---|
| DE | 19724648 | A1 | 12/1998 |
| EP | 1886837 | A1 | 2/2008 |

(Continued)

OTHER PUBLICATIONS

International Search Report issued by the ISA/EP in connection with PCT/US2015/059432 on Jan. 27, 2016.

*Primary Examiner* — Bruce H Hess

(74) *Attorney, Agent, or Firm* — Levenfeld Pearlstein, LLC

(57) ABSTRACT

An embossed heat transfer label includes a carrier, embossing layer, release coating, design layer, and adhesive layer, in which the embossing layer is formed to include an embossing pattern, and the design layer is configured to take up the embossing pattern from the embossing layer. The embossed heat transfer label is configured such that the design layer and the adhesive layer transfer to a target object upon application of heat and pressure, while the embossing layer and the release coating is removed and disposed with the carrier. The exposed design layer provides an embossed surface on the target object. The label can include a flat profile layer on which the design layer is printed.

26 Claims, 4 Drawing Sheets

(56) References Cited

U.S. PATENT DOCUMENTS

| | | | |
|---|---|---|---|
| 5,281,290 | A | 1/1994 | Bosler |
| 5,346,746 | A | 9/1994 | Abrams |
| 5,635,282 | A | 6/1997 | Suess et al. |
| 5,919,834 | A | 7/1999 | Downs et al. |
| 6,083,332 | A | 7/2000 | Abrams |
| 6,110,560 | A | 8/2000 | Abrams |
| 6,909,444 | B2 | 6/2005 | Ishida et al. |
| 7,364,782 | B2 | 4/2008 | Abrams |
| 7,410,682 | B2 | 8/2008 | Abrams |
| 7,465,485 | B2 | 12/2008 | Abrams |
| 7,910,203 | B2 | 3/2011 | Colella et al. |
| 2004/0053001 | A1 | 3/2004 | Abrams |
| 2005/0266204 | A1 | 12/2005 | Abrams |
| 2008/0050548 | A1 | 2/2008 | Abrams |
| 2008/0095973 | A1 | 4/2008 | Abrams |
| 2008/0102239 | A1 | 5/2008 | Abrams |
| 2011/0223373 | A1 | 9/2011 | Abrams |
| 2012/0015156 | A1 | 1/2012 | Abrams |
| 2012/0028003 | A1 | 2/2012 | Abrams |
| 2013/0251922 | A1 | 9/2013 | Colella et al. |
| 2014/0193609 | A1 | 7/2014 | Colella et al. |

FOREIGN PATENT DOCUMENTS

| | | | |
|---|---|---|---|
| JP | H10 157399 | A | 6/1998 |
| WO | 0181080 | A1 | 11/2001 |
| WO | 2006108611 | A2 | 10/2006 |
| WO | 2013096402 | A2 | 6/2013 |
| WO | 2013141978 | A2 | 9/2013 |

EMBOSSED HEAT TRANSFER LABELS

CROSS-REFERENCE TO RELATED APPLICATION DATA

This application claims the benefit of and priority to provisional U.S. Patent Application Ser. No. 62/078,775, filed Nov. 12, 2014, the disclosure of which is incorporated herein in its entirety.

BACKGROUND

Heat transfer labels are well known and used in various industries. For example, heat transfer labels are used to transfer indicia onto fabrics and other substrates. Typically, heat transfer labels include thermoplastic color layers capable of being adhered to substrates upon application of heat and pressure.

UV curing heat transfer labels are also known. UV curing heat transfer labels can provide advantages over solvent-based or water-based thermoplastic ink systems since they do not emit volatile organic compounds and they exhibit improved abrasion resistance and chemical resistance. Such UV curing heat transfer labels are disclosed in Downs et al., U.S. Pat. No. 5,919,834, and Colella et al., US Publication 2013/0251922, which documents are commonly assigned with the present application and are incorporated in their entirety by reference. Colella et al. discloses a textured heat transfer label.

Heat transfer labels with a textured feel (e.g. raised and/or recessed areas) can be produced by using an embossed carrier. Such a label is produced by printing on a carrier film which has been embossed with the pattern that it is desired to transfer to the item being decorated. However, such textured labels require an embossing process step, which can increase production costs (e.g. embossing tooling and added production step.) Additionally, a single embossing tool will provide a single repeated pattern that does not lend itself to further customization.

Accordingly, there is a need for an improved embossed heat transfer label that provides a high level of customization, repeatability, durability and wash-fastness.

BRIEF SUMMARY

Embossed heat transfer labels (e.g. those with raised and/or recessed areas) according to various embodiments are provided. The embossed heat transfer label includes at least one embossing layer having an embossing pattern printed on a carrier using a cross-linkable polymer ink, and at least one design layer printed over the embossing layer using a cross-linkable polymer ink for accepting the embossing pattern from the embossing layer. The embossed heat transfer label is configured such that the design layer separates from the embossing layer and transfers to a target object during a heat transfer process. Further, the embossing layer and the design layer are cross linked prior to the heat transfer process, such that these layers do not deform and distort the embossing pattern during the heat transfer process.

In one aspect, an embossed heat transfer label comprising a carrier, at least one embossing layer, at least one design layer, and at least one adhesive layer is provided. The at least one embossing layer is formed from a first cross-linkable composition and provided on the carrier. The at least one embossing layer includes an embossing pattern. The at least one design layer is provided on the carrier over the at least one embossing layer. The at least one design layer is formed from a second cross-linkable composition and configured to take up the embossing pattern from the at least one embossing layer. Further, the at least one adhesive layer and the at least one design layer are configured to separate from the at least one embossing layer and the carrier, and transfer and adhere to a target object upon application of heat and pressure. The at least one design layer is configured to maintain the embossing pattern transferred from the at least embossing layer and provide an embossed surface on the target object.

In some embodiments, the first cross-linkable composition is a silicone ink. For example, the at least one embossing layer may be formed by printing two passes one the carrier using a 2K silicone ink. In one of such embodiments, the embossed heat transfer label is configured such that some portions of the at least one design layer is in direct contact with the carrier, in which the adhesion between the at least one embossing layer and the carrier is greater than the adhesion between the at least one design layer and the carrier. Further, the adhesion between the at least one embossing layer and the carrier is greater that an adhesion between the at least one embossing layer and the at least one design layer. In a different embodiment, the at least one design layer is printed on the at least one embossing layer such that no portion of the least one deign layer is in direct contact with the carrier. In such an embodiment, the embossed heat transfer label is configured such that the adhesion between the at least embossing layer and the carrier is greater than the adhesion between the at least design layer and the embossing layer.

Further, the embossing heat transfer label may also include at least one background layer and/or a lacquer layer, which may be provided between the at least one design layer and the at least one adhesive layer.

Yet in another embodiment, the embossed heat transfer label also includes a release coating layer arranged between the at least one embossing layer and the at least one design layer, in which the release coating layer is printed over the at least one embossing layer, such that the release coating has a larger print area than the at least one embossing layer, the at least one design layer, and the at least one adhesive layer. In this embodiment, no portion of the at least one embossing layer is in direct contact with the at least one design layer. In such an embodiment, the release coating layer may be formed from a wax comprising thermoplastic polyamide resin, and the first cross-linkable composition may be a UV curable ink. Further, the adhesion between the release coating layer and the embossing layer and the adhesion between the release coating and the carrier is greater than the adhesion between the release coating and the design layer.

In some embodiments, the second cross-linkable composition may be an ink formulation comprising a thermoplastic resin and a cross-linking agent. For example, the ink formulation may contain a thermoplastic resin, polyol and isocyanate, and in which the thermoplastic resin is selected from thermoplastic polyurethanes, vinyl chloride/vinyl acetate copolymers, polymethacrylates, epoxides, and copolyesters. Further, the ink composition may also include at least one of color pigment, metallic material, fluorescent, pearlescent, and iridescent specialty pigment.

The at least one adhesive layer may be formed from an adhesive composition comprising a thermoplastic resin and hotmelt power. The at least one adhesive layer may also be formed from a hotmelt powder resin, in which the hotmelt powder resin is selected from thermoplastic polyurethanes, copolyesters, and copolyamides.

In any of the above discussed embodiments, the at least one embossing layer and the at least one design layer are cross linked prior to application of heat and pressure to transfer the at least one design layer and the at least one adhesive layer to the target object.

In another aspect, a method of making an embossed transfer label is provided. The method includes steps of printing at least one embossing layer on a carrier using a silicone ink composition, printing at least one design layer over the at least one embossing layer using an ink composition that contains at least one thermoplastic polymer and a cross linking agent, printing an adhesive layer on the at least one design layer, curing the silicone ink composition; and cross linking the second ink composition.

In yet another aspect, a method of making an embossed transfer label is provided. The method includes steps of printing at least one embossing layer on a carrier using a first ink composition that includes at least one cross-linkable thermoplastic polymer and a cross linking agent, printing a release coating layer over the at least one embossing layer, printing at least one design layer over the release coating layer using a second ink composition that includes at least one thermoplastic polymer and a cross linking agent, printing an adhesive layer on the at least one design layer, cross linking the first ink composition, and cross linking the second ink composition. The cross linking of the first ink composition and the second ink composition may be performed at a same time or at different times. Further, the step printing the at least one embossing layer may include applying a UV curable ink on the carrier via screen printing according to a design, in which the first composition is cross linked by exposing the at least one embossing layer to a UV light source.

In still another aspect, a method of making an embossed transfer label includes printing at least one embossing layer on a carrier using a silicone ink composition, printing at least one profile layer over the at least one embossing layer with a composition including at least one thermoplastic polymer and a cross linking agent and printing at least one design layer over the at least one profile layer using an ink composition including at least one thermoplastic polymer and a cross linking agent. The method further includes printing an adhesive layer on the at least one design layer, curing the silicone ink composition and cross linking the profile layer and the design layer ink composition, through heat. In a method, the profile layer, after printing, has a flat surface and the design layer is printed onto the profile layer flat surface.

In yet another aspect, a method of making an embossed transfer label includes printing at least one embossing layer on a carrier using a first ink composition including at least one cross-linkable thermoplastic polymer and a cross linking agent and printing a profile layer over the at least one embossing layer. The method also includes printing at least one design layer over the profile layer using a second ink composition including at least one thermoplastic polymer and a cross linking agent and printing an adhesive layer on the at least one design layer. Still further, the method includes cross linking the first ink composition and cross linking the second ink composition. Cross linking the first ink composition and crosslinking the second ink composition can be performed simultaneously or at different times.

In a method, printing the at least one embossing layer can includes applying a heat curable embossing ink layer on the carrier via screen printing according to a design. Cross linking the first ink composition can include exposing the at least one embossing layer to a heat source.

Other aspects, objectives and advantages will become more apparent from the following detailed description when taken in conjunction with the accompanying drawings.

BRIEF DESCRIPTION OF THE DRAWINGS

The benefits and advantages of the present embodiments will become more readily apparent to those of ordinary skill in the relevant art after reviewing the following detailed description and accompanying drawings, wherein.

DETAILED DESCRIPTION

Figure 1:
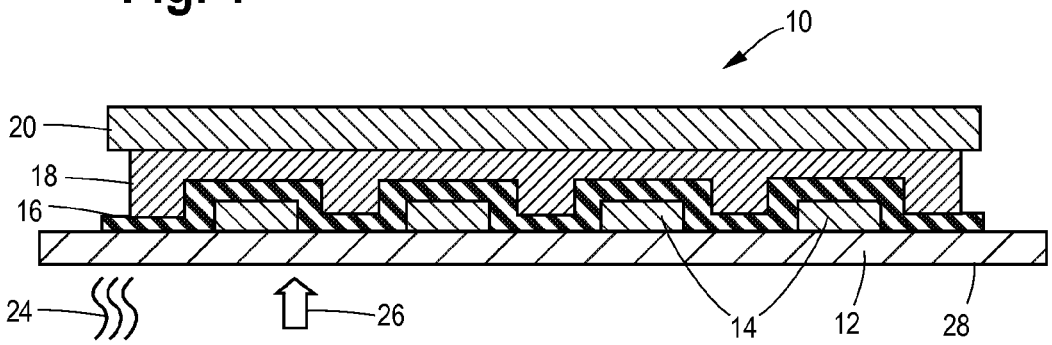
FIG. 1 is a schematic cross sectional view of an embossed heat transfer label according to an embodiment.

While the present disclosure is susceptible of embodiment in various forms, there is shown in the drawings and will hereinafter be described presently preferred embodiments with the understanding that the present disclosure is to be considered an exemplification and is not intended to limit the disclosure to the specific embodiments illustrated.

Figure 2:
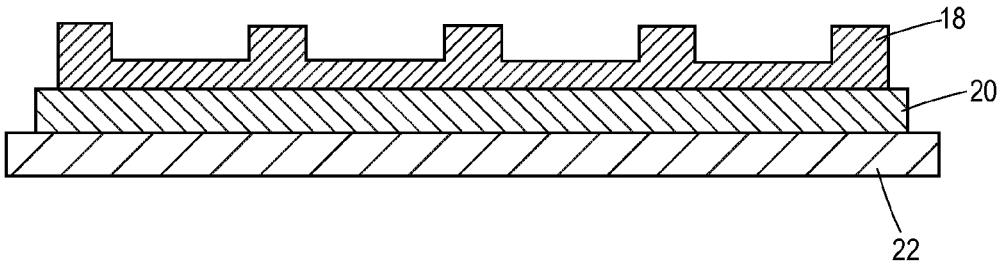
FIG. 2 is a schematic cross sectional view of the embossed heat transfer label of FIG. 1 applied on a substrate.

Referring now to the figures, FIG. 1 shows a schematic cross sectional view of an embodiment of an embossed heat transfer label 10. Layer thicknesses are exaggerated for easy understanding and are not proportional in this embodiment and other embodiments shown in other figures in this disclosure. The embossed heat transfer label 10 generally includes a carrier 12, an embossing layer 14, a release coating 16, a design layer 18 and an adhesive layer 20. The embossed heat transfer label 10 is configured such that the adhesive layer 20 and the design layer 18 transfer and adhere to a target object 22, such as a fabric (FIG. 2), upon application of heat 24 and pressure 26 on an outer surface 28 of the carrier 12. When applied on the target object 22, the design layer 18 provides an embossed feature on the surface of the target object 22 as shown in FIG. 2.

Typically, textured or embossed heat transfer labels are made using a pre-embossed carrier, in which a design layer is printed on a carrier that is pre-embossed with a desired pattern or design. However, this requires embossing tooling and embossing process steps to emboss the carrier, which can increase the production cost for the labels. Further, customization of embossing patterns can be time consuming and expensive, since a new embossing pattern requires a new embossing die.

The need for such a pre-embossed carrier in prior art labels is eliminated in the present embossed heat transfer label. In the embossed heat transfer label 10, the embossing layer 14, which is printed on the carrier 12, includes an embossing pattern to replace a pre-embossed carrier in prior art. Thus, the production steps are simplified and the production cost is reduced from eliminating embossing steps and embossing tooling for embossing a carrier. Further, the printed embossing layer 14 makes variety of designs possible for the embossing pattern, and the embossing design can be easily customized or altered. For example, a label may be selectively embossed by confining an embossing pattern to a particular area on the label by printing the embossing layer only in a desired area of the label.

In one embodiment, the embossing layer 14 is printed according to a desired design. The embossing layer 14 may be printed to a specified depth or multiple depths depending on the design requirement. In some embodiments, the embossing layer 14 may include multiple different patterns. For example, one area of the label 10 may include a pattern made up of dots of a certain size, while another area may include a pattern made up of squares of a certain size. For the purpose of this disclosure, an "embossing pattern" may include one design pattern or multiple design patterns. Further, the embossing layer 14 may be formed by more than one print path to provide various depths and designs of the embossing pattern. Various known printing methods may be used to print the embossing layer 14, such as screen printing.

The embossing layer 14 is formed from a material that can retain the embossing pattern under the heat 24 and pressure 26 applied during the label transferring process to the target object 22. Suitable materials for the embossing layer 14 include cross-linkable polymer inks. For example, the embossing layer 14 may be formed from a UV curable ink that is highly cross-linked when cured. The UV curable ink can be prepared by dissolving a thermoplastic resin in a monomer, an oligomer, or a monomer/oligomer mixture, and incorporating into a finished photoinitiated ink system. It should be understood that any monomer, oligomer, or monomer/oligomer mixture which can dissolve the thermoplastic resin component and remain compatible with the other components of the labels are acceptable. Suitable monomers for dissolving the thermoplastic resin component include esters of acrylic acid and methacrylic acid such as lauryl acrylate, isobornyl acrylate, 2-phenoxyethyl acrylate, glycidyl methacrylate, tetraethoxylated nonylphenol acrylate, and propoxylated neopentyl glycol diacrylate.

Thermoplastic resins suitable for the UV curable ink include epoxies, polyurethanes, polymethacrylates, polyethylene vinyl acetates, polyvinyl chlorides, vinyl chloride/vinyl acetate copolymers, functionalized vinyl chloride/vinyl acetate copolymers, chlorinated halogenated polyolefins such as chlorinated and fluorinated polyolefins, and polystyrene. Additionally, thermoplasticity (i.e. adhesion) can be promoted by preparing a coating made from monofunctional acrylates. Oligomers can be added to improve the physical and chemical properties of the finished coating.

Suitable photocurable monomer initiators include benzophenone, alpha ketone, thiophenyl morpholinopropanone (Irgacure® 907), morpholinophenylaminohexanone (Irgacure® 369), cyclohexylphenyl ketone (Irgacure® 184), hydroxyphenylpropanone (Darocur® 1173), and isopropylthioxanthone (Darocur® ITX), alkylated benzophenone (Esacure® TZT), diphenyl(2,4,6-trimethylbenzoyl) phosphine oxide (Genocure® TPO), and poly 4-(2-hydroxy-2-methylpropionyl) alpha-methyl styrene (Escacure® KIP-100F). Irgacure® 907, 369, 184, Darocur® 1173, and Darocur® ITX are products available from BASF. Genocure® TPO is a product of RAHN. Generally, suitable initiators are those which produce free radicals upon exposure to UV radiation.

UV curable ink formulations similar to those disclosed in the aforementioned Downs et al., U.S. Pat. No. 5,919,834, which is incorporated herein in its entirety by reference, can be used to print the embossing layer 14. Preferably, the embossing layer 14 is formed using a highly cross-linked UV ink composition, which is formulated to bond to the carrier 12 and the release coating 16. The composition includes more initiator or cross-linking agent than the formulations disclosed in Downs et al. The highly cross-linked density of the cured UV ink provides a hard, durable raised structure on the carrier 12, which functions as an embossing pattern. The UV ink formulations in Downs et al. are formulated to be heat transferable inks, while the UV ink formulation for the embossing layer 14 need not be a heat transferable ink since the embossing layer 14 is not configured to transfer to the target object 22. Rather, it is configured to remain bonded to the carrier 12 under the release coating 16, and retain the solid raised structure of the embossing pattern.

Curing of the UV curable ink can be effected by exposing the ink to a suitable UV source, such as a Fusion Systems light source, using either a doped mercury type "D" or "V" lamp. The "D" outputs in the wavelength range of 340-390 nm. The "V" lamp outputs in the 400-430 nm range. The choice of pigment and initiator dictate which range (i.e. lamp) to use, and the selection process would be readily understood by the artisan skilled in printing with traditional UV curing inks. The UV curable ink is exposed under a suitable UV light source, which cures or cross links the UV curable ink into the embossing layer 14 formed of a highly cross-linked UV ink.

Other suitable materials for the embossing layer 14 includes solvent based inks and water based inks comprising cross-linkable polymers and a cross linking agent. For example, a suitable solvent based ink may be formulated with a hydroxyl functional resin and a polyisocyanate cross linking agent.

The embossing layer 14 may be printed on the carrier layer 12 formed from various materials, such as a paper or plastic film. One preferred carrier material is polyester film, which provides a suitable surface for printing the embossing layer 14 and favorable mechanical properties. For example, polyester does not soften and become tacky at the range of temperatures typically encountered during the label transfer process to the target object 22.

In one embodiment, the carrier 12 is formed from a 92 gauge (92 ga) clear, untreated packaging grade polyester film as is well known in the art. As can be readily appreciated, one benefit of using a clear material for carrier layer 12 is that, if desired, one can inspect the quality of the subsequent printed layers of the label 10 by looking at the layers through the carrier 12.

The material for the carrier 12 is selected such that surface energy for the carrier 12 is sufficiently high for printing the embossing layer 14 and the release coating 16, and allow the embossing layer 14 and the release coating 16 to remain bonded to the carrier 12 after the design layer 18 and the adhesive layer 20 are transferred to the target object 22 upon application of heat 24 and pressure 26.

The release coating 16 is printed over the embossing layer 14 on the carrier 12. As shown in FIG. 1, the release coating 16 is printed in a larger area than the embossing layer 14 and design layer 18. The release coating 16 is provided between the embossing layer 14 and the design layer 18, such that the release coating 16 completely covers the embossing layer 14 and no portion of the embossing layer 14 is in direct contact with the design layer 18. The release coating 16 is provided to facilitate a clean separation of the design layer 18 and the adhesive layer 20 from the rest of the label structures upon application of heat 24 and pressure 26. Without the release coating 16, the embossing layer 14 may bond to the design layer 18 and separate from the carrier 12 upon application of heat 24 and pressure 26, and transfer to the target object 22 with the design layer 18 and the adhesive layer 20. Thus, the embossed heat transfer label 10 is configured to include the release coating 16, which has greater adhesion to the embossing layer 14 and the carrier 12 than to the design layer 18 to facilitate separation of the design layer 18 from the release coating 16 upon application of heat 24 and pressure 26.

In one embodiment, the release coating 16 may be formed from a wax comprising thermoplastic polyamide resin having a softening point below the label application temperature. In such an embodiment, the release coating 16 softens at application and becomes an anti-blocking layer, which allows the design layer 18 and the adhesive layer 20 to release and transfer to the target object 22.

The design layer 18 is printed over the release coating 16 and the embossing layer 14 on the carrier 12. The designed layer 18 is formed using a material that can take up the embossing pattern from the embossing layer 14 and retain the embossing pattern during the heat transfer process to the target object 22. Further, design layer 18 is configured to separate from the release coating 16 and embossing layer 14, and transfer to the target object 22 and retain the embossing pattern when attached to the target object 22. Similar to the embossing layer 14, suitable materials for the design layer 18 include cross-linkable inks. For example, the design layer 18 may be formed from an ink composition including a thermoplastic resin and a cross-linking agent. The suitable ink compositions may include UV curable inks and cross-linkable solvent based or water based inks. Further, the suitable ink compositions may be formulated such that when the embossed label is attached to the target object 22, such as a fabric, the ink compositions can provide durability necessary for laundry testing while retaining the embossed pattern.

Suitable thermoplastic resins for the ink formulation for the design layer 18 include, but are not limited to, thermoplastic polyurethanes, vinyl chloride/vinyl acetate copolymers, polymethacrylates, epoxies, and copolyesters. The ink formulation may be formulated with polyols and isocyanates to provide cross-linking necessary for laundry durability of the ink surface. Further, the ink formulation may be pigmented with color, metallic, fluorescent, pearlescent, and/or iridescent specialty pigments. The ink may be clear or pigmented, which gives rise to different effects.

The embossing layer 14 and the design layer 18, which may be formed from a same ink formulation or different cross-linkable ink formulations, are cross linked prior to the heat transfer process. The cross linking of the embossing layer 14 and the design layer 18 may be performed simultaneously or at different times. For example, in one embodiment, the embossing layer 14 may be formed using a UV curable ink formulation, while the design layer 18 is formed from a solvent based ink formulation containing a hydroxyl resin and a polyisocyanate cross linking agent. In such an embodiment, UV curable embossing layer 14 may be cross linked during the printing process which may occurs before either the release coating 16 or the design layer 18 are printed, while the cross linking of the design layer 18 is carried out after the completion of the printing process. In this embodiment, the design layer 18 is typically cured under an ambient condition for 7 days after printing. The ambient curing of the design layer 18 formed from a solvent based or water based cross-linkable ink formulation may be accelerated with application of heat. For example, the solvent based ink formulation containing a hydroxyl resin and a polyisocyanate cross linking agent, which typically cures for 7 days at room temperature, may be cured in 12 hours at 165° F. In another embodiment, both embossing layer 14 and design layer 18 may be formed using a UV curable ink, which may be cured simultaneously when the layers are exposed to UV light after printing.

In some embodiments, the design layer 18 may be formed by multiple ink passes. In such embodiments, multiple passes of different color inks and designs may be printed to produce a multicolored graphic. Further, the design layer 18 may be printed in multiple passes to yield a label with a higher raised design layer 18. Further, the first print path of the design layer 18 formed by multiple print passes may be a clear protective layer.

Finally, the adhesive layer 20 is applied over the design layer 18. The adhesive layer 20 may be formed from a thermoplastic composition that melts or softens upon application of heat 24 and pressure 26, and adheres to the target object 22 to attach the embossed design layer 18 to the target object 22. In applications where the target object 22 is a fabric material, the thermoplastic composition may be formulated with thermoplastic resins and hotmelt powders. Suitable hotmelt powder resins for fabric materials include, but are not limited to, thermoplastic polyurethanes, copolyesters, and copolyamides. In such a thermoplastic composition, the hotmelt powder may be dispersed in thermoplastic resin binder and may have a particle size distribution suitable for the screen mesh being used for printing.

To apply the embossed heat transfer label 10, the label 10 is placed on the target object 22, such as a fabric, such that the adhesive layer 20 faces the target object 22. After adjusting the label 10 to a desired position on the target object 22, sufficient heat 24 and pressure 26 are applied to the outer surface 28 of the carrier 12 using conventional heat transfer equipment. When heat and pressure are applied to the carrier 12, the adhesive layer 20 melts or softens, and adheres to the target object 22. Subsequently, a user may peel off the carrier 12, embossing layer 14, and release coating 16 by grapping and pulling away the carrier 12 from the target object 22. After the carrier 12 is removed along with the embossing layer 14 and release coating 16, the design layer 18 and the adhesive layer 20 remain attached to the target object 22. The exposed design layer 18 reveals the embossed pattern or design on the target object 22, which has been transferred to the design layer 18 from the embossing layer 14 as shown in FIG. 2.

It should be understood that the particular compositions of the carrier 12, embossing layer 14, release coating 16, design layer 18, and adhesive layer 20 may vary from the specific compositions disclosed herein depending upon the composition of a target object to which the label 10 is to be applied and the desired embossing pattern.

Figure 3:
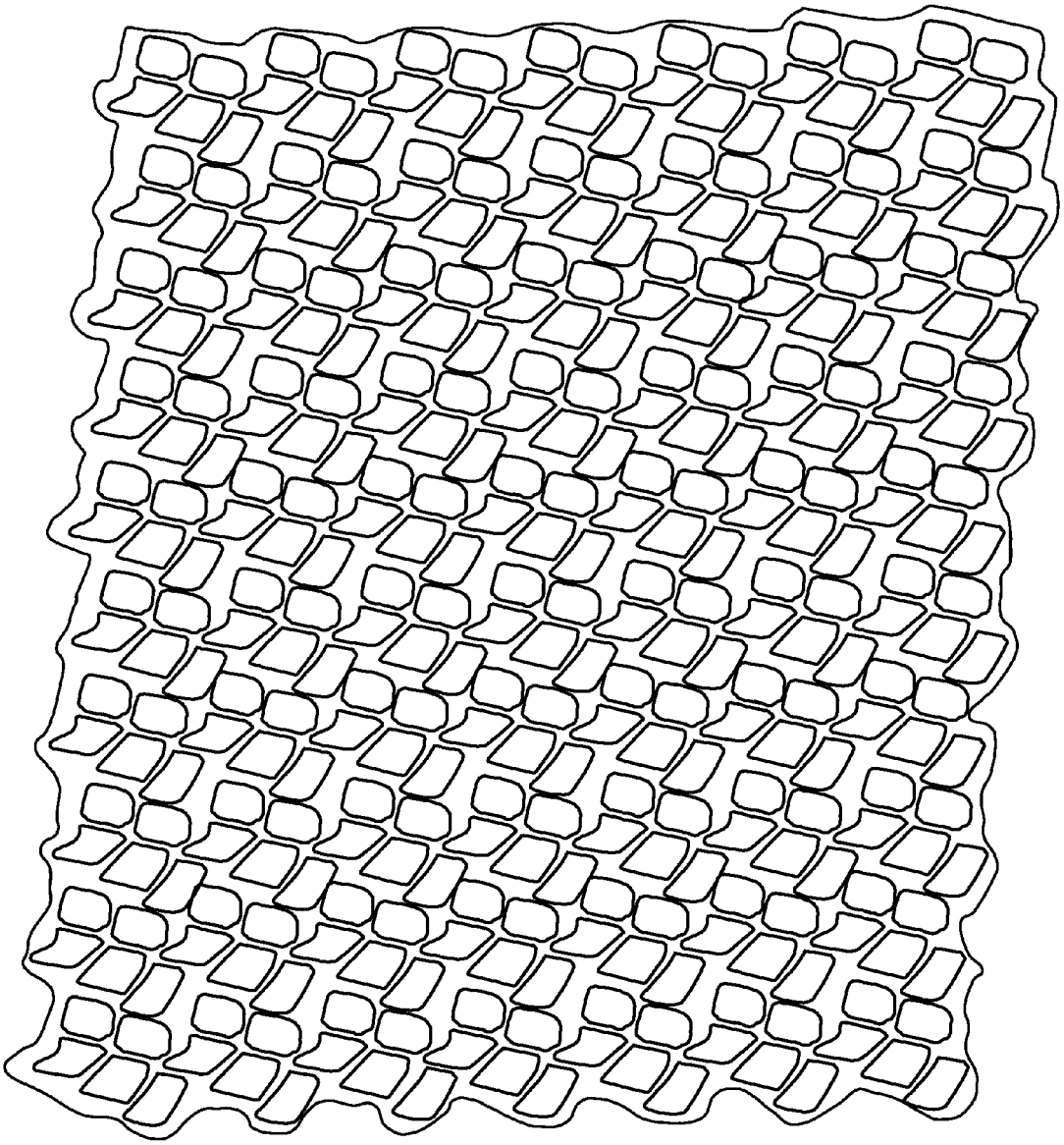
FIG. 3 is a photograph of an example of an embossed heat transfer label including a snakeskin pattern.

FIG. 3 is a photograph of a sample textured heat transfer label applied on a fabric substrate. As shown, the sample includes a raised snakeskin pattern.

Figure 4:
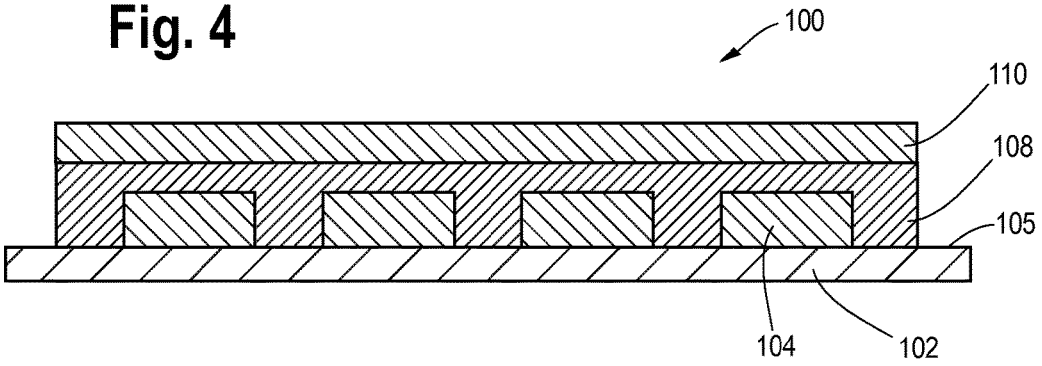
FIG. 4 is a schematic cross sectional view of an embossed heat transfer label according to an embodiment.

FIG. 4 is a schematic cross sectional view of an embossed heat transfer label 100 according to an embodiment. The embossed heat transfer label 100 generally includes a carrier 102, an embossing layer 104, a design layer 108 and an adhesive layer 110. The label 100 is similarly configured as the embossed heat transfer label 10 of FIG. 1, except the release coating 16, which was provided between the embossing layer 14 and the design layer 18 to prevent the design layer 18 from sticking to the embossing layer 14, is eliminate in the label 100. This is made possible by forming the embossing layer 104 from a silicone ink to allow the design layer 108 to separate from the embossing layer 104 without sticking during heat transfer application. Further, the embossed heat transfer label 100 may provide a sharper embossed image when the design layer 108 and adhesive layer 110 are transferred and attached to a target object, since the design layer 108 is directly printed on the silicone embossing layer 104 without a release coating layer therebetween.

In an embodiment, the embossing layer 104 is printed on a carrier 102 using a silicone ink. Suitable silicone inks for the embossing layer 104 include, but are not limited to, a 2K (two-component) silicone ink. The carrier 102 may be formed from a plastic or paper release liner. Suitable materials for the carrier 12 of the embodiment shown in FIG. 1 are also suitable for the carrier 102. The carrier 102 is configured such that the design layer 108 separates from the carrier 102 and transfers to a target object during heat transfer application, while the embossing layer 104 remains bonded to the carrier 102. Thus, the embossed heat transfer label 100 is configured such that the adhesion between the embossing layer 104 and carrier 102 is greater than the adhesion between design layer 108 and the carrier 102. Further, the adhesion between the embossing layer 104 and the carrier 102 is greater than the adhesion between the design layer 108 and the embossing layer 104.

In some embodiments, the carrier 102 includes a release coating on a print surface 105, which is configured to provide a sufficiently high adhesion between the carrier 102 and the embossing layer 104 so that the embossing layer 104 remains bonded to the carrier 102 during printing and heat transfer application, while the design layer 108 separates and transfers to a target object during the heat transfer application. In an embodiment, the embossing layer 104 is screen printed using a 2K silicone ink on the carrier 102 formed from a siliconized 92 gauge polyester film. The 2K silicone ink is 100% solid, thus, can provide an embossing texture while providing a surface, over which the design layer 108 may be printed without being bonded to the embossing layer 104 to allow the design layer 108 to separate and transfer to a target object during heat transfer application, leaving behind the embossing layer 104 on the carrier 102.

Figure 5:
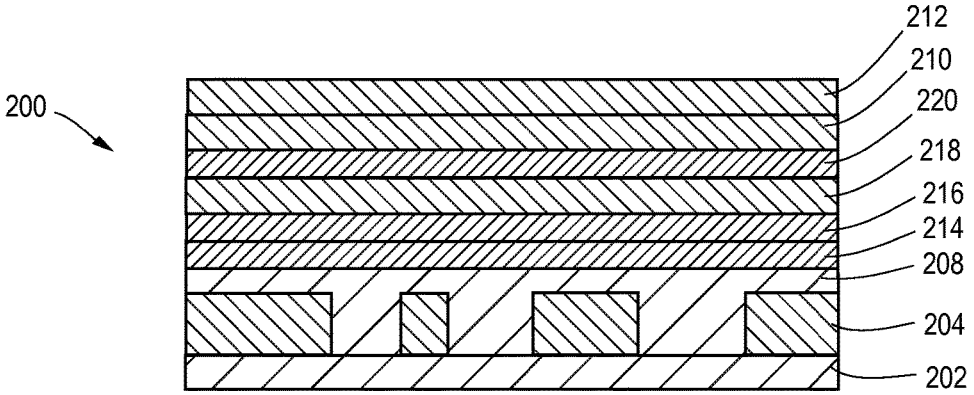
FIG. 5 is a schematic cross sectional view of an embossed heat transfer label according to another embodiment.

FIG. 5 is a schematic cross sectional view of an embossed heat transfer label 200 according to yet another embodiment. The embossed heat transfer label 200 is designed for apparel applications, and includes an embossing layer formed from a silicone material similar to the embodiment shown in FIG. 4. The embossed heat transfer label 200 generally includes a carrier 202, an embossing layer 204, a design layer 208, background layers 214, 216, 218, a lacquer layer 220, and adhesive layers 210, 212.

The carrier 202 may be formed from any of the suitable materials discussed above with regard to the carrier 102. For example, the carrier 202 may be formed from a paper or plastic release liner. The embossing layer 204 is formed from a layer of a silicone ink. For example, the embossing layer 204 may be formed by a single print pass using a silicone ink, such as Alpatec® 30340, which is available from CHT R. Beitlich GMBH. Subsequently, the design layer 208 is printed over the embossing layer 204. The suitable materials discussed above with regard to design layer 18 and 108 of the embodiments shown in FIGS. 1 and 4 are also suitable for the design layer 208.

The label 200 also includes the background layers 214, 216, 218. In this embodiment, the background layers are formed by printing two layers 214, 216 using a white ink and one layer 218 using a silver ink. The label 200 further includes a lacquer layer 220. In this embodiment, the label 200 includes two layers of adhesive 210, 212. The adhesive layers 210, 212 may be formed by any of the suitable materials discussed above with regard to the adhesive layers 20, 110 of the embodiments shown in FIGS. 1 and 4.

Figure 6:
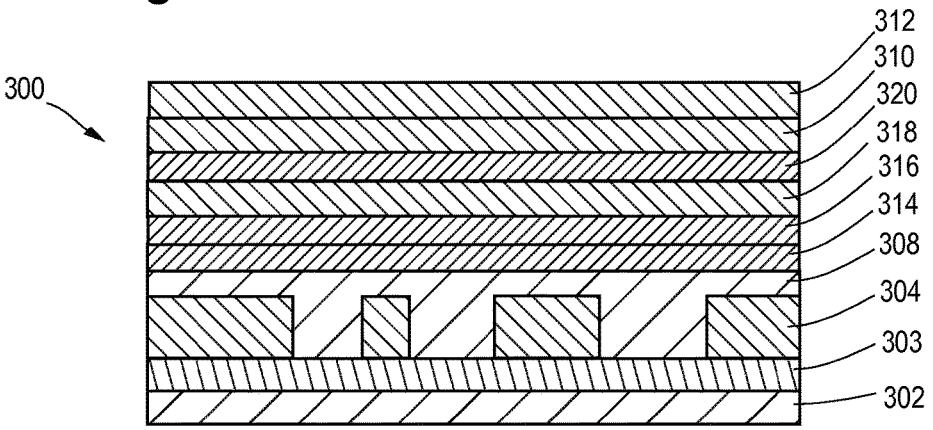
FIG. 6 is a schematic cross sectional view of an embossed heat transfer label according to yet another embodiment.

FIG. 6 illustrates another embodiment of an embossed heat transfer label 300. The embossed heat transfer label 300 is constructed similar to the label 200 shown in FIG. 5, except the embossing layer of the label 300 is formed by two print passes of a silicone ink. The embossed heat transfer label 300 generally includes a carrier 302, embossing layers 303, 304, a design layer 308, white background layers 314, 316, a silver background layer 318, a lacquer layer 320, and adhesive layers 310, 312.

When compared to the heat transfer label 200, the heat transfer label 300, which includes the embossing layers 303, 304 formed via two passes of a silicone ink, can provide a softer, more subtle embossing look, while the label 200 including the embossing layer 204 formed via a single pass of a silicone ink may provide sharper embossing details.

Figure 7A:
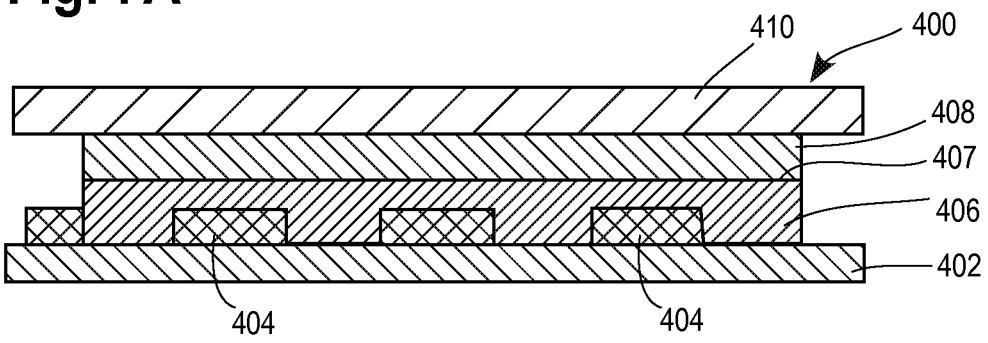
FIG. 7A is a schematic cross-sectional view of an embossed heat transfer label according to still another embodiment.

FIG. 7A is a schematic cross sectional view of yet another embodiment of an embossed heat transfer label. The embossed heat transfer label 400 is designed for a variety of applications, such as application to an apparel item. The label includes a carrier 402 which may be formed from any of the suitable materials discussed above with regard to carrier 102. An embossing layer 404 is provided on the carrier layer 402. The embossing layer 404 is formed from a layer of a silicone ink. For example, the embossing layer 404 may be formed by a single print pass, by, for example, screen printing, using a silicone ink, such as Alpatec® 30340, which is available from CHT R. Beitlich GMBH. A preferred embossing layer material is a heat cured material.

A profile layer 406 is applied over the embossing layer 404. The profile layer 406 can be formed from, for example, a suitable thermoplastic resin having a cross linking agent, such as thermoplastic polyurethanes, vinyl chloride/vinyl acetate copolymers, polymethacrylates, epoxies, and copolyesters, formulated with polyols and isocyanates to provide the cross-linking necessary for laundry durability of the ink surface. The profile layer 406 may be clear or pigmented, which gives rise to different effects. One benefit of the profile layer 406 is that it provides a flat or even surface, as illustrated at 407, on which to apply the design layer 408.

The design layer 408 is printed over the profile layer flat surface 407. The suitable materials discussed above with regard to design layer 18, 108, 208 and 308 of the embodiments shown in the earlier figures are also suitable for the design layer 408. As noted above, one benefit of providing the design layer 408 over the profile layer 406 is that the profile layer 406 provides a flat or even surface 407 on which to apply the design layer 408. In that the design layer 408 may include a number of layers to, for example, provide different colors in a desired pattern, the smooth or flat surface 407 of the profile layer 408 permits better registration (alignment) of the different colors and/or patterns of the design layer 408 onto the label 400. Those skilled in the art will recognize the difficulties that may arise in registration when applying colors and/or designs in a pattern on a label, and in particular when the surface onto which the design is applied is not flat or even (as when the surface is embossed). The use of a flat or smooth surface 407 on the profile layer 406 addresses and overcomes these problems.

Following the design layer 408, an adhesive layer 410 is applied to the label 400. The adhesive layer 410 may be formed by and from any of the suitable materials discussed above with regard to the adhesive layers of the previously discussed embodiments. The first and second ink compositions (i.e., the embossing layer 404 and the design layer 408) can be cured, as by the application of heat, simultaneously or at different times. In an embodiment, the design layer 408 has a thickness of about 4 microns and the profile layer has thickness of about 10-12 microns.

Figure 7B:
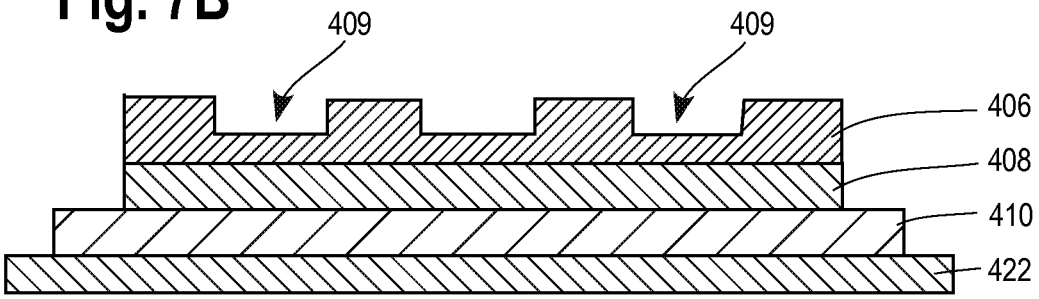
FIG. 7B is schematic cross-sectional view of the heat transfer label of FIG. 7A as applied to a substrate.

FIG. 7B illustrates the label embodiment of FIG. 7A when applied to an item 422. As illustrated, the adhesive layer 410 adheres the label 400 to the item 422. The design layer 408 (again, which may include a number of layers to, for example, provide different colors in a desired pattern) is adhered to the item 422 by the adhesive layer 410 and the profile layer 406 which includes the embossings or reliefs as indicated at 409 is adhered to the design layer 408. The embossings or reliefs 409 are formed as a result of the profile layer 406 being applied over the embossing layer 404 which embossing layer 404 remains adhered to the carrier 402. As noted above, the profile layer 406 may be clear or pigmented, to give rise to different effects over the design layer 408.

The words "a" or "an" are to be taken to include both the singular and the plural. Conversely, any reference to plural items shall, where appropriate, include the singular. All patents and published application referred to in this disclosure are incorporated herein in their entirely whether or not expressly done so herein.

From the foregoing it will be observed that numerous modifications and variations can be effectuated without departing from the true spirit and scope of the novel concepts of the present disclosure. It is to be understood that no limitation with respect to the specific embodiments illustrated is intended or should be inferred. The disclosure is intended to cover by the appended claims all such modifications as fall within the scope of the claims.

What is claimed is:

1. An embossed heat transfer label, comprising:

a carrier;

at least one embossing layer formed from a first cross-linkable composition printed directly on the carrier in a desired embossing pattern;

at least one design layer provided on the carrier over the at least one embossing layer, the at least one design layer formed from a second cross-linkable composition and configured to take up the embossing pattern from the at least one embossing layer; and at least one adhesive layer;

wherein the at least one adhesive layer and the at least one design layer are configured to separate from the at least one embossing layer and the carrier, and transfer and adhere to a target object upon application of heat and pressure, and wherein the at least one design layer is configured to maintain the embossing pattern transferred from the at least embossing layer and provide an embossed surface on the target object.

2. The embossed heat transfer label of claim 1, wherein the first cross-linkable composition is a silicone ink.

3. The embossed heat transfer label of claim 2, wherein some portions of the at least one design layer are in direct contact with the carrier, wherein an adhesion between the at least one embossing layer and the carrier is greater than an adhesion between the at least one design layer and the carrier, and the adhesion between the at least one embossing layer and the carrier is greater that an adhesion between the at least one embossing layer and the at least one design layer.

4. The embossing heat transfer label of claim 2, wherein the at least one design layer is printed on the at least one embossing layer such that no portion of the least one deign layer is in direct contact with the carrier, wherein an adhesion between the at least embossing layer and the carrier is greater than an adhesion between the at least design layer and the embossing layer.

5. The embossing heat transfer label of claim 4, wherein the at least one embossing layer by printing two passes using a 2K silicone ink.

6. The embossing heat transfer label of claim 1, further including at least one background layer between the at least one design layer and the at least one adhesive layer.

7. The embossing heat transfer label of claim 1, further including a lacquer layer between the at least one design layer and the at least one adhesive layer.

8. The embossing heat transfer label of claim 1, further including a release coating layer arranged between the at least one embossing layer and the at least one design layer, wherein the release coating layer is printed over the at least one embossing layer, such that the release coating has a larger print area than the at least one embossing layer, the at least one design layer, and the at least one adhesive layer, such that no portion of the at least one embossing layer is in direct contact with the at least one design layer.

9. The embossed heat transfer label of claim 8, wherein the first cross-linkable composition is a UV curable ink.

10. The embossed heat transfer label of claim 8, wherein the release coating layer is formed from a wax comprising thermoplastic polyamide resin.

11. The embossed heat transfer label of claim 8, wherein an adhesion between the release coating layer and the embossing layer and an adhesion between the release coating and the carrier is greater than an adhesion between the release coating and the design layer.

12. The embossed heat transfer label of claim 1, wherein the second cross-linkable composition is an ink formulation comprising a thermoplastic resin and a cross-linking agent.

13. The embossed heat transfer labels of claim 12, wherein the ink composition further includes at least one of color pigment, metallic material, fluorescent, pearlescent, and iridescent specialty pigment.

14. The embossed heat transfer label of claim 1, wherein the second cross-linkable composition is an ink formulation comprising a thermoplastic resin, polyol and isocyanate, and wherein the thermoplastic resin is selected from thermoplastic polyurethanes, vinyl chloride/vinyl acetate copolymers, polymethacrylates, epoxides, and copolyesters.

15. The embossed heat transfer label of claim 1, wherein the at least one adhesive layer is formed from an adhesive composition comprising a thermoplastic resin and hotmelt power.

16. The embossed heat transfer label of claim 1, wherein the at least one adhesive layer is formed from a hotmelt powder resin, and wherein the hotmelt powder resin is selected from thermoplastic polyurethanes, copolyesters, and copolyamides.

17. The embossed heat transfer layer of claim 1, wherein the at least the one embossing layer and the at least one design layer are cross linked prior to application of heat and pressure to transfer the at least one design layer and the at least one adhesive layer to the target object.

18. A method of making an embossed transfer label, comprising steps of:

printing at least one embossing layer on a carrier using a silicone ink composition;

printing at least one design layer over the at least one embossing layer using an ink composition including at least one thermoplastic polymer and a cross linking agent;

printing an adhesive layer on the at least one design layer;

curing the silicone ink composition; and cross linking the ink composition that includes at least one thermoplastic polymer and a cross linking agent.

19. A method of making an embossed transfer label, comprising steps of:

printing at least one embossing layer directly on a carrier in a desired embossing pattern using a first ink composition including at least one cross-linkable thermoplastic polymer and a cross linking agent;

printing a release coating layer over the at least one embossing layer;

printing at least one design layer over the release coating layer using a second ink composition including at least one thermoplastic polymer and a cross linking agent;

printing an adhesive layer on the at least one design layer;

cross linking the first ink composition; and cross linking the second ink composition, wherein the cross linking of the first ink composition and the crosslinking of the second ink composition are performed at a same time or at different times.

20. The method of claim 19, wherein printing the at least one embossing layer includes applying a UV curable ink on the carrier via screen printing according to a design, wherein cross linking the first composition includes exposing the at least one embossing layer to a UV light source.

21. A method of making an embossed transfer label, comprising steps of:

printing at least one embossing layer on a carrier using a silicone ink composition;

printing at least one profile layer over the at least one embossing layer with a composition including at least one thermoplastic polymer and a cross linking agent;

printing at least one design layer over the at least one profile layer using an ink composition including at least one thermoplastic polymer and a cross linking agent;

printing an adhesive layer on the at least one design layer;

curing the silicone ink composition; and cross linking the profile layer and the design layer ink composition, through heat.

22. The method of claim 21 wherein the profile layer, after printing, has a flat surface and wherein the design layer is printed onto the profile layer flat surface.

23. A method of making an embossed transfer label, comprising steps of:

printing at least one embossing layer on a carrier using a first ink composition including at least one cross-linkable thermoplastic polymer and a cross linking agent;

printing a profile layer over the at least one embossing layer;

printing at least one design layer over the profile layer using a second ink composition including at least one thermoplastic polymer and a cross linking agent;

printing an adhesive layer on the at least one design layer;

cross linking the first ink composition; and cross linking the second ink composition.

24. The method of claim 23 wherein cross linking the first ink composition and crosslinking the second ink composition are performed simultaneously.

25. The method of claim 23 wherein cross linking the first ink composition and crosslinking the second ink composition are performed at different times.

26. The method of claim 23, wherein printing the at least one embossing layer includes applying a heat curable embossing ink layer on the carrier via screen printing according to a design, and wherein cross linking the first ink composition includes exposing the at least one embossing layer to a heat source.

* * * * *